US008669459B2

(12) United States Patent
Oshimi et al.

(10) Patent No.: US 8,669,459 B2
(45) Date of Patent: Mar. 11, 2014

(54) SOUND PROCESSING APPARATUS, METHOD FOR SOUND PROCESSING, PROGRAM AND RECORDING MEDIUM

(75) Inventors: Masao Oshimi, Tokyo (JP); Ryo Gobara, Tokyo (JP)

(73) Assignee: CRI Middleware Co., Ltd., Tokyo (JP)

( * ) Notice: Subject to any disclaimer, the term of this patent is extended or adjusted under 35 U.S.C. 154(b) by 348 days.

(21) Appl. No.: 13/117,514

(22) Filed: May 27, 2011

(65) Prior Publication Data

US 2011/0303074 A1 Dec. 15, 2011

(30) Foreign Application Priority Data

Jun. 9, 2010 (JP) ..... 2010-131680

(51) Int. Cl.
*G10H 1/00* (2006.01)

(52) U.S. Cl.
USPC ..... 84/622; 84/659; 84/600

(58) Field of Classification Search
USPC ..... 84/600–602, 622, 659, 653
See application file for complete search history.

(56) References Cited

U.S. PATENT DOCUMENTS

| | | | | |
|---|---|---|---|---|
| 5,915,043 | A * | 6/1999 | Ueda | 382/233 |
| 7,003,448 | B1 * | 2/2006 | Lauber et al. | 704/200.1 |
| 2001/0016010 | A1 * | 8/2001 | Kim | 375/240.25 |
| 2007/0282600 | A1 * | 12/2007 | Ojanpera | 704/207 |
| 2008/0133250 | A1 * | 6/2008 | Hsiao | 704/500 |
| 2008/0140428 | A1 * | 6/2008 | Choo et al. | 704/500 |
| 2009/0070420 | A1 * | 3/2009 | Quackenbush | 709/204 |
| 2009/0157394 | A1 * | 6/2009 | Singhal | 704/205 |
| 2010/0014679 | A1 * | 1/2010 | Kim et al. | 381/23 |

FOREIGN PATENT DOCUMENTS

JP 2002-58030 2/2002

* cited by examiner

*Primary Examiner* — David S. Warren
(74) *Attorney, Agent, or Firm* — Greenblum & Bernstein, P.L.C.

(57) ABSTRACT

The sound-processing apparatus of the present invention generates plural frequency data by decoding plural encoded sound data and applying inverse quantization. Each of the frequency data are subjected to sound-processing and then synthesized into one single frequency data. Transformation processing from frequency domain to time domain is applied to the synthesized single frequency data so as to generate sound data in time domain so as to reduce computation amounts of decoding process.

12 Claims, 5 Drawing Sheets

SOUND PROCESSING APPARATUS, METHOD FOR SOUND PROCESSING, PROGRAM AND RECORDING MEDIUM

TECHNICAL FIELD

The present invention relates to processing of encoded sound data, and more particularly relates to a sound-processing apparatus, a method for sound-processing, a program and a recording medium which reduce computation amounts upon play-backing the encoded sound data.

BACKGROUND ART

Conventionally, there is a technique for play-backing a sound data in an encoded format (hereafter referred to encoded sound data) by decoding thereof in order to play-back the sound data. Usually the encoded sound data is decoded, subjected to transformation processing such as inverse quantization, inverse discrete cosine transformation (IDCT: Inverse Discrete Cosine Transform) or inverse modified discrete cosine transformation (IMDCT: Inverse Modified Discrete Cosine Transform), and sub-band filtering, IIR (Infinite impulse response) processing etc. to generate expanded data.

As techniques for accelerating decoding processing of such encoded sound data, JP 2002-58030 (Patent Literature 1), for example, discloses a decoding apparatus for encoded sound data which calculates frequency data by decoding variable length codes from the encoded sound signal for decoding scale factors and subjecting inverse quantization and then subjecting frequency-time transformation to the derived frequency data to output digital sound signals. The disclosed decoding apparatus for encoded sound data uses an IMDCT circuit to conduct the frequency-time transformation processing which at most requires computation amounts and processing time in the decoding processing, by using an IMDCT circuit to accelerate the decode processing of the sound signal.

PRIOR ART LITERATURE

Patent Literature

[Patent Literature 1] JP 2002-58030

SUMMARY OF INVENTION

Object Addressed by Invention

The technique disclosed in the above Patent Literature, however, adopts the construction that the IMDCT processing is applied to the sequentially decoded single sound data. When the above technique is adopted to user interactive type apparatuses which must decode a plurality of sound data interactively and non-synchronously in response to user operations such as, for example, a video game machine, a pinball machine, a gaming machine, a car navigation system, an ATM, or a karaoke machine, the IMDCT processing must be applied to all of the encoded sound data such that the calculation amounts for the IMDCT processing inevitably increases with respect to numbers of the sound data to be decoded. In addition, the decoding processing of a plurality of the sound data which occurs non-synchronously may not speed up so that a CPU circuit size, which is requested to minimize in embedded system apparatus such as the above gaming machine, becomes large and the electric power consumption thereof may increase.

The present invention is completed to address to the above conventional problem, and the object of the present invention is to provide a sound-processing apparatus, a method for sound-processing, a program and a recording medium which reduce computation amounts and improve efficiency of the decoding process when play-backing a plurality of sound data by interactive user operations.

Means for Address to Object

Thus, the present invention provides the sound-processing apparatus which generates plural frequency data by decoding plural encoded sound data and applying inverse quantization. According to the present invention, each of the frequency data are subjected to sound-processing and then synthesized into one single frequency data. Transformation processing from frequency domain to time domain is applied to the synthesized single frequency data so as to generate sound data in time domain. Thus, the present invention may significantly reduce computation amounts required to the transformation processing compared to the architecture which applies transformation processing that consumes much computation amounts to all of the plural sound data to be play-backed, thereby the CPU circuit size may be reduced and the electric power consumption amounts may be reduced.

As such according to the present invention, a sound-processing apparatus, a method for sound-processing, a program and a recording medium, which reduce computation amounts and improve efficiency of the decoding process when play-backing a plurality of sound data by interactive user operations, may be provided.

EMBODIMENT PRACTICING INVENTION

Now, the present invention will be described using practical embodiments, however, the present invention must not be limited by the embodiments described hereafter.

Figure 1:
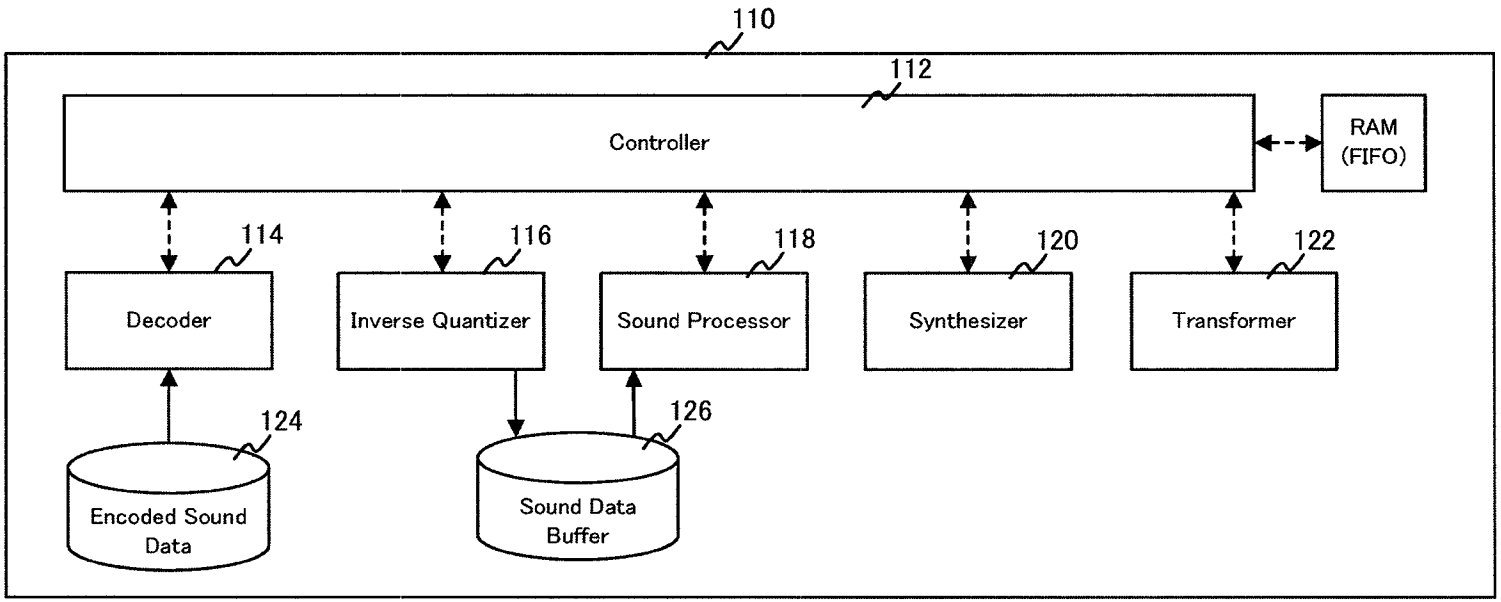
FIG. 1 shows a functional construction 100 of a sound-processing apparatus 110 of the present invention.

FIG. 1 shows the functional construction of the sound-processing apparatus 110 according to the present invention which decodes a plurality of sound data. The sound-processing apparatus 110 comprises the controller 112, the decoder 114, the inverse quantizer 116, the sound processor 118, the storage apparatus 124, and the sound data buffer 126.

The controller 112 is the functional means which controls each of the functional means implemented on the sound-processing apparatus 110 and the controller 112 may execute the decoding processing of the encoded sound data by adequately invoking the functional means detailed elsewhere. When the controller 112 receives a play-back request for the sound data from hardware or higher level applications etc.

triggered by operations of a user for the sound-processing apparatus 110, the controller 112 invokes the decoder 114, the inverse quantizer 116, and the sound processor 118 to decode and to apply the inverse quantization and processing to the encoded sound data. Then, the controller 112 determines whether or not the controller 112 received another play-back request for other sound data. When the other sound data to be play-backed is present, the controller 112 decodes and applies the inverse quantization and processing to the objected encoded sound data.

According to the present embodiment, the controller 112 receives the play-back request for the other sound data while the decode, inverse quantization and processing of a certain sound data are going on, the play-back request may be buffered in RAM as a FIFO style. Then, the controller 112 may determine with referring to the RAM whether or not the other sound data to be play-backed in same time is present or exists.

Further according to the present invention, the controller 112 makes the inverse quantizer 116 apply the inverse quantization to the sound data decoded by the decoder 114 to store thereof in the sound data buffer 126. Then, the controller 112 makes the sound processor 118 retrieve frequency data of the sound data to be play-backed from the sound data buffer 126 to apply the processing. In this case, the controller 112 may refer the RAM to which the play-back request(s) is/are stored and determines the frequency data to be processed and may make the sound processor 118 execute the processing. When the decoding, the inverse quantization and the processing are completed at the end of the sound data objected to the play-back, the controller 112 clears the play-back request of the currently objected sound data as described later.

When the controller 112 completes the decoding, the inverse quantization, and the processing for all of the sound data to be play-backed at the same time, the controller 112 may invoke the synthesizer 120 and the transformer 122 for synthesis and transformation of the above sound data.

The storage apparatus 124 is a memory means to which the encoded sound data to be play-backed by the sound-processing apparatus 110 is stored and may be implemented using non-volatile memory devices such as a hard disk apparatus (HDD), EPROM, or a flash memory and the like. The encoded sound data is binary data representing the sound data expressed by binary numerals corresponding to sampling numbers separated with a certain time duration. The encoded sound data is the sound data which is generated by applying the MDCT processing, the DCT processing, the sub-band filtering processing or the IIR filtering processing, and further the quantization processing and the encoding processing. In the present embodiment, Huffman encoding protocol may be adopted as the encoding process. A plurality of encoded sound data are stored in the storage apparatus 124 in relation to the encoded sound data identifiers which are capable of identifying uniquely each of the encoded sound data.

The decoder 114 is the functional means which generates quantized data by decoding the encoded sound data stored in the storage apparatus 124. The decoder 114 decodes the encoded sound data designated by the play-back request of the sound data. The play-back request comprises the sound data identifier for the encoded sound data to be play-backed, and the decoder 114 retrieves the encoded sound data to be play-backed using the sound data identifier from the storage apparatus 124. The decoding processing of the present embodiment may be adopted as variable length decoding processes such as, for example, Huffman decoding protocol.

The inverse quantizer 116 is the functional means which generates the frequency data of the sound data to be play-backed, which corresponds to frequency region data of the sound data, by subjecting the quantized data of the sound data decoded by the decoder 114 to the inverse quantization. According to the present embodiment, the inverse quantizer 116 may store the generated frequency data to the sound data buffer 126. The sound data buffer 126 may be implemented by using a memory device such as RAM etc. and the frequency data in a block unit may be overwritten for the save thereof.

The sound processor 118 is, for example, the functional means which executes volume and/or acoustic parameter adjustment processing of the sound data to be play-backed. More particularly, the sound processor 118 may apply the volume/sound as well as acoustic adjustment processing which the volume is modified or adjusted by multiplying the gain for the volume of the sound data to be play-backed to each component of the frequency data included in the sound data. Here, the term sound/acoustic adjustment herein may include possible adjustments for tone, frequency, echo, sound feeling, sound depth, other sound embedding, mixing and the like. In addition, the sound processor 118 may apply the panning processing which adjusts sound images by multiplying right and left gains of the sound data to be play-backed to each of the frequency data in the sound data.

In the present embodiment, the sound processor 118 may apply the sound-processing by retrieving the frequency data stored in the sound data buffer 126. Then, the synthesizer 120 detailed elsewhere synthesizes the frequency data of a plurality of sound data after sound-processing. In another embodiment, the sound processor 118 may store the frequency data of the sound data after the sound-processing in the sound data buffer 126 and the synthesizer 120 may apply the synthesis of the frequency data of plurality of sound data after sound-processing by retrieving thereof from the sound data buffer.

According to the present embodiment, the sound processor 118 may obtain the gain of the sound data to be applied with the sound-processing by referring to a database which stores the sound data identifier and associated sound gains identified by the sound data identifier. Alternatively, according to the present embodiment, the sound processor 118 may obtain the gains of the sound data to be processed by referring a database to which the sound data identifier and right and left sound gains identified by the sound data identifier are stored relationally.

In another embodiment, the higher level application which transmits the play-back request of the sound data may obtain the gains of the sound data to be applied with the sound-processing by identifying the sound data identifier and the gain thereof for the sounds to be play-backed in the play-back request of the sound data. In further another embodiment, the higher level application transmitting the play-back request of the sound data may obtain the gains of the sound data to which the sound-processing is to be applied by indicating the sound data identifier and the left and right gains of the sound to be play-backed in the play-back request of the sound data. Further in another embodiment, the higher level application may obtain the gains of the sound data to which the sound-processing is to be applied by indicating the sound data identifier, the left and right gains of the sound and the ratio of the right and left gains to be play-backed in the play-back request of the sound data.

Furthermore, the sound-processing apparatus 110 may comprise the synthesizer 120 and the transformer 122.

The synthesizer 120 is the functional means which synthesizes a plurality of sound-processed data that are the frequency data of the sound-processed sound data into a single synthesized data. The synthesizer 120 may be invoked by the controller 112 when the decoding, the inverse quantization, and sound-processing are completed on all of the sound data to be play-backed at the same time, and may retrieve and synthesize all of the sound-processed data stored in the sound data buffer 126 to generate the frequency data of the single sound data, namely the synthesized data.

According to the present embodiment, the synthesizer 120 is explained by assuming that the synthesize processing is applied to the sound/acoustically processed data, which is generated by the sound processor 118, by retrieving the sound data from the sound data buffer 126; however, in the another embodiment, the sound processor 118 may store the sound/acoustically processed data in the sound data buffer 126 in relation to the sound data identifier thereof and the controller 112 may cause the synthesizer 120 execute the synthesize processing by designating the soundly/acoustically processed data to be synthesized with the sound data identifier thereof.

The transformer 122 is the functional means which executes the transformation processing in which data domain of the single synthesized data generated by the synthesizer 120 is transformed. The present transformation processing may include the IMDCT processing, the IDCT processing, the sub-band filtering processing and the IIR filtering processing. The transformer 122 may generate the sound signal in the time domain data by applying the domain transformation to the synthesized data as the frequency domain data.

The present sound-processing apparatus 110 performs the synthesis by decoding the encoded sound data in the block unit and then applying the inverse quantization processing and the sound-processing to the decoded sound data; however, in another embodiment, the synthesis may be performed by decoding the encoded sound data by one frequency component and then applying the inverse quantization and the sound-processing thereto. The above processes may be repeated for one block length about all of the sound data to be play-backed at the same time to generate the synthesized data for one block length. In this embodiment, the data buffer for storing a plurality of frequency data for one block length may be omitted so that the inverse quantization and the sound-processing of the sound data may be allowed without using the sound data buffer and therefore the overall processing of the sound-processing apparatus may be speeded up.

The present sound-processing apparatus 110 may be implemented to a sound play-back apparatus including, for example, game machines such as a video gaming machine, a pinball game machine, a slot machine, or other gaming machines, a car navigation system, an automated teller machine (ATM), and a karaoke machine etc. which play-back sounds interactively by user operations. The present sound-processing apparatus 110 may include a CPU or MPU such as PENTIUM (Trade Mark) processor and the compatible processor thereof and may run the program of the present invention described in the programming languages such as assembler, C, C++, Java (Trade Mark), JavaScript (Trade Mark), PERL, RUBY, PYTHON etc. under the management of OS such as ITRON, Windows (Trade Mark) series, Mac (Trade Mark) OS series, UNIX (Trade Mark), or LINUX (Trade Mark). Furthermore, the sound-processing apparatus 110 may include RAM for providing working space of the program, HDD for storing the program and data etc. permanently such that the functional means of the present embodiment may be functioned by the execution of the program on the present sound-processing apparatus.

Each of the present functional means may be functioned by the apparatus through executable program described by the above programming languages, and the present program may be distributed in a apparatus readable recording medium such as a hard disk apparatus, CD-ROM, MO, a flexible disk, EEPROM, or EPROM and may be transmitted through a network in a format executable in another apparatus.

Figure 2:
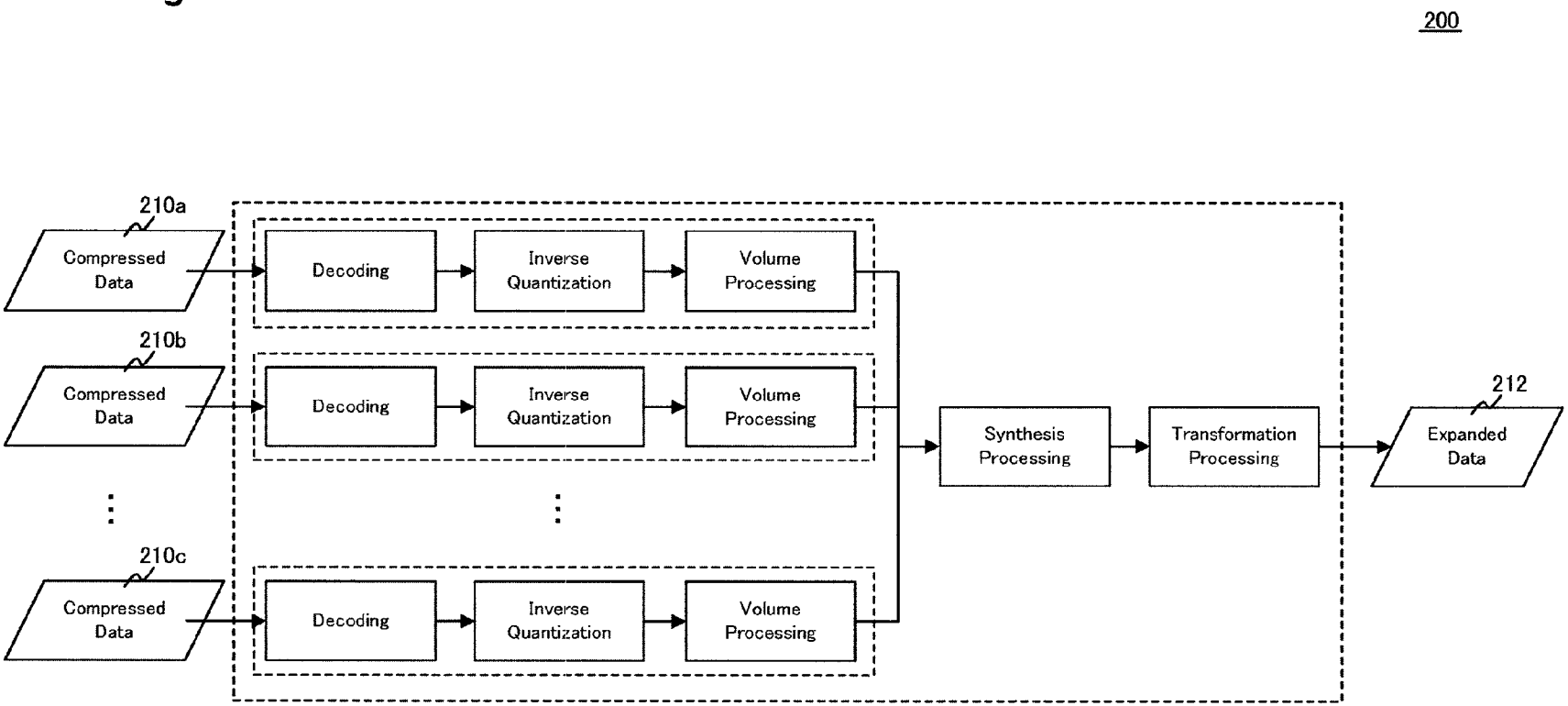
FIG. 2 shows a schematic diagram of processing executed by a sound-processing apparatus 110 of the present invention.

FIG. 2 shows the schematic view of the decoding process executed by the sound-processing apparatus 110. The sound-processing apparatus 110 retrieves compressed data 210*a*, 210*b*, 210*c* which are the encoded sound data designated by the play-back request for the sound data arisen from user operations on the sound-processing apparatus 110 from the storage apparatus 124, and the decoding, the inverse quantization, sound-processing are applied to each of the compressed data. When the sound-processed data of the sound data to be play-backed at the same time are generated, the sound-processing apparatus 110 synthesizes the above sound-processed data through synthesize processing and then applies to the single synthesized data to obtain the expanded data 212 through transformation processing. In the present embodiment, the transformation processing, which requires much of computation amount in the total processing is applied to only one synthesized data such that the computation amount required for transformation processing may be significantly reduced compared to the strategy in which the transformation processing is applied to all of the sound data to be play-backed, thereby the circuit size of CPU may be reduced while reducing electric power consumption thereof.

Figure 3:
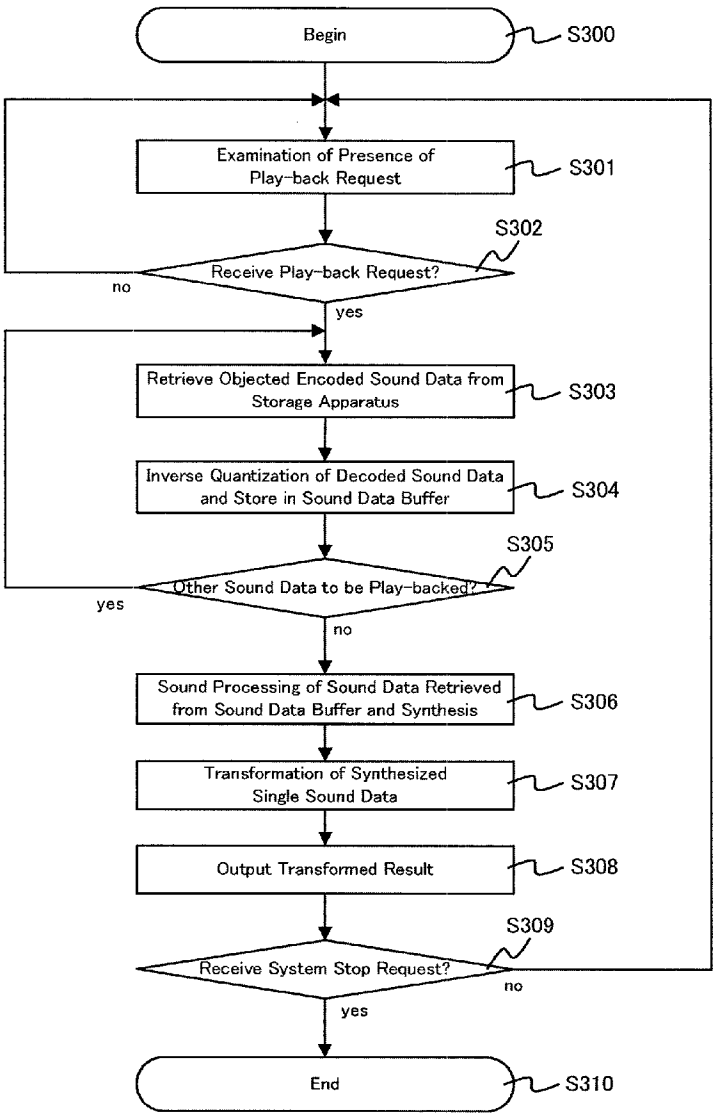
FIG. 3 shows a flowchart of a process executed by a sound-processing apparatus of the present invention.

FIG. 3 shows the flowchart of the process executed by the present sound-processing apparatus 110. The process of FIG. 3 begins from the Step S300 and in the Step S301, the controller 112 of the sound-processing apparatus 110 inquires the presence or not of the play-back request for the sound data. In the step S302, the controller 112 determines whether or not the play-back request for the sound data is present. When the request is not present (no), the controller 112 reverts the process to the step S301 to repeat the steps S301 and S302. On the other hand, when the determination that the play-back request for the sound data is present has been made at the determination of the step S302 (yes), the process is diverted to the step S303.

In the step S303, the decoder 114 retrieves the encoded sound data designated in the play-back request from the storage apparatus 124 using the sound data identifier. In the step S304, the controller 112 invokes the inverse quantizer 116. The inverse quantizer 116 performs inverse quantization to the decoded sound data to generate the frequency data if there is the sound data and then stores the frequency data to the sound data buffer 126.

In the step S305, the controller 112 determines whether or not other sound data to be decoded is present by determining the presence of the play-back request for the sound data in RAM. When the determination that there is the other sound data to be play-backed is present (yes), the process is diverted to the step S303. On the other hand, when the determination that there is no other sound data to be play-backed is made (no), the process is diverted to the step S306.

In the step S306, the controller 112 invokes the sound processor 118. The sound processor retrieves the frequency data from the sound data buffer 126 to apply sound-processing thereto. Furthermore, the controller 112 invokes the synthesizer 120 and the synthesizer 120 performs the synthesis processing to all of the frequency data of the sound data to which the sound-processing was applied. In the step S307, the controller 112 invokes the transformer 122, and the transformer 122 performs the transformation to the synthesized single sound data. In the step S308, the controller 112 outputs the sound data to which the transformation is applied. In the step S309, the controller 112 determines whether or not a stop request from the OS of the sound-processing apparatus 110 received, and when the stop request has not received yet (no), the process is reverted to the step S301 to repeat the process to the step S301. On the other hand, the stop request has received (yes), the process is diverted to the step S310 to end the process.

According to the present embodiment, the output of the sound data is performed by writing the sound data to a sound buffer after application of the transformation process, which is read by the sound play-back apparatus; however, in the other embodiment, the sound data may be written out as a file etc. or may be transmitted to the sound play-back apparatus through the network.

Figure 4:
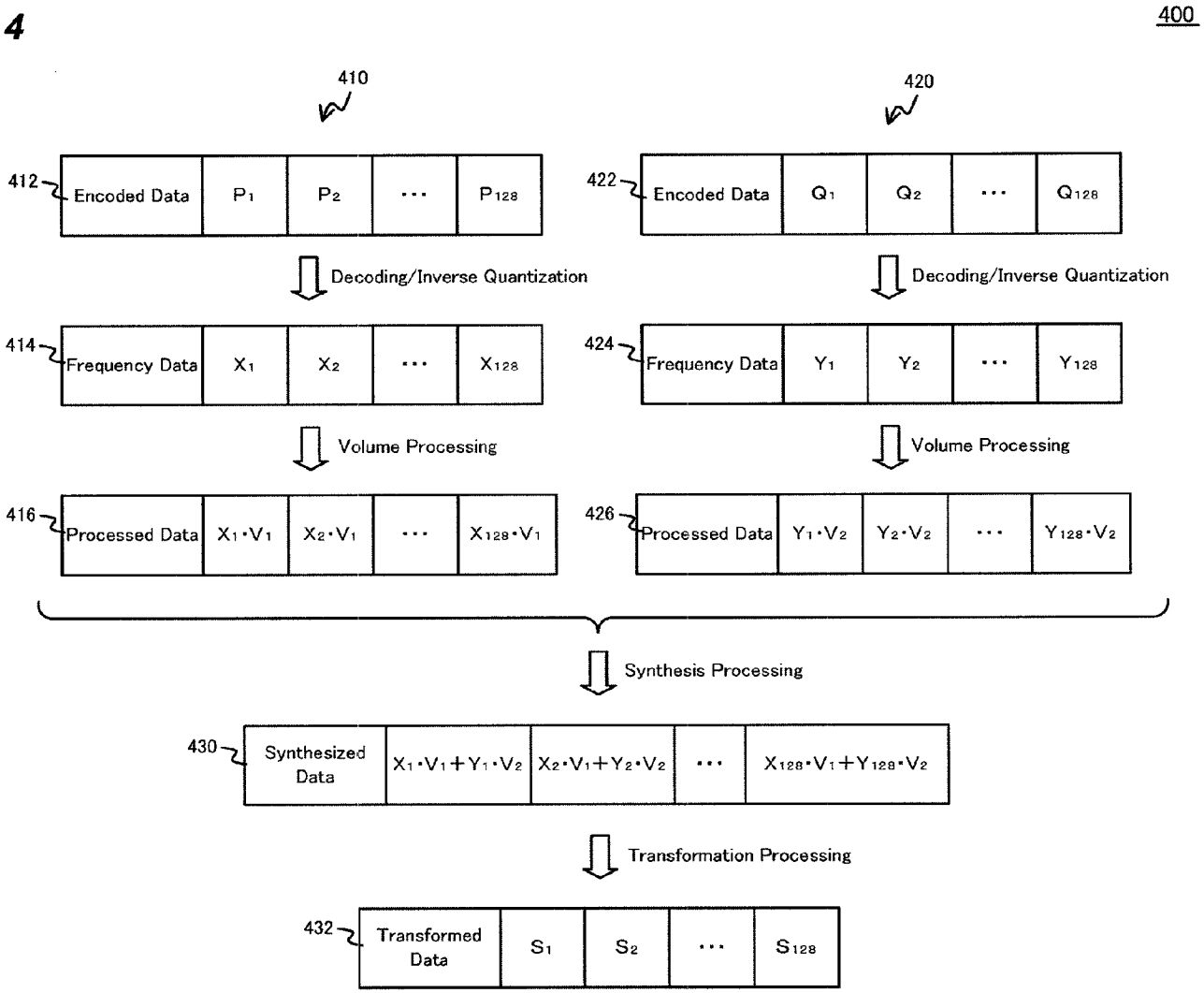
FIG. 4 shows a schematic diagram of sound-processing executed by a sound-processing apparatus 110 of the present invention.

FIG. 4 shows the schematic diagram of a sample embodiment of the sound-processing which is executed by the present sound-processing apparatus 110. In the embodiment depicted in FIG. 4, the decoding, inverse quantization, sound/acoustic-processing, synthesis, and transformation are applied to two sound data 410, 420 which are play-backed at the same time. The present sound data 410, 420 are transformed in a 128 sampling unit, and in the other embodiment, the sound data 410 420 may be transformed in sampling unit in power-of-2 (two). Furthermore, according to the present embodiment, the transformation process is explained by assuming that two sound data 410, 420 are of monaural; however, in the other embodiment, the transformation process may be applied to multi-channel sound data.

The encoded data 412, 422 are the encoded sound data of the sound data 410, 420 which are before execution of the decoding process, and each comprises binary data $P_1$-$P_{128}$ and $Q_1$-$Q_{128}$ as their data components. The frequency data 414, 424 are the data each generated by decoding and performing the inverse quantization to the encoded data 412, 422 and each comprises the data components $X_1$-$X_{128}$ and $Y_1$-$Y_{128}$ which represent frequency characteristics such as waveforms or frequencies of sampling data.

The sound-processed data 416, 426 are the data which are derived by performing the sound-processing to the frequency data 414, 424. The sound-processing shown in FIG. 4 is explained by assuming that the sound-processing is the volume adjustment processing for modifying or adjusting the volume of the sound data and the sound-processing is attained by multiplying the gain V1 of the sound data 410 to each components of the frequency data 414 to generate the sound-processed data 416. Similarly, the sound-processed data 426 may be generated by multiplying the gain V2 of the sound data 420 to each components of the frequency data 424.

The synthesized data 430 is the data obtained by performing the synthesizing processing to the sound-processed data 416, 426 and is obtained by adding each data components of the sound-processed data 416, 426. By applying the transformation processing to the synthesized data 430 the transformation data 432 (S1, S2, . . . , S128) as the sound signals for sound data 410 and 420 may be generated.

Figure 5:
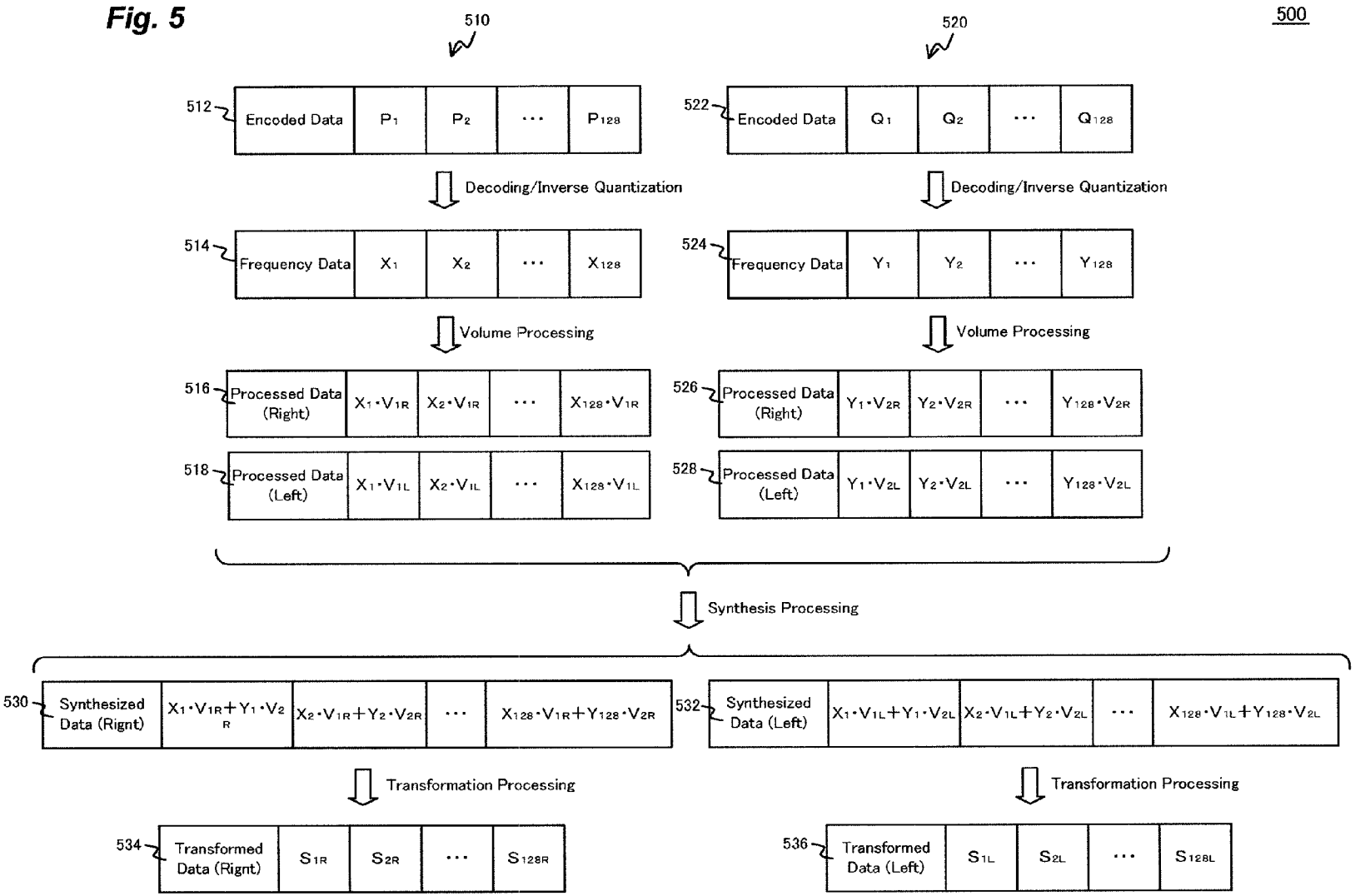
FIG. 5 shows a schematic diagram of sound-processing in another embodiment executed by a sound-processing apparatus 110 of the present invention.

FIG. 5 shows the schematic illustration of another sound-processing embodiment being executed by the present sound-processing apparatus 110. In the embodiment shown in FIG. 5, as described in FIG. 4, the decoding, the inverse quantization, the sound-processing, synthesis processing and the transformation processing are applied to two sound data 510, 520 which are play-backed at the same time. The sound data 510, 520 of the present embodiment is, as the embodiment of FIG. 4, are transformed in the 128 sampling unit; however, the sound data may be transformed in the sampling units in power-of-2 (two). Furthermore, in the present embodiment, the transformation process is explained by assuming that two sound data 510, 520 are of monaural; however, in the other embodiment, the transformation process may be applied to multi-channel sound data.

The encoded data 512, 522 are the encoded sound data of the sound data 510, 520 before execution of the decoding process and each comprises binary data $P_1$-$P_{128}$ and $Q_1$-$Q_{128}$ as their data components. The frequency data 514, 524 are the data each generated by decoding and performing the inverse quantization to the encoded data 512, 522 and each comprises the data components $X_1$-$X_{128}$ and $Y_1$-$Y_{128}$ which represent frequency characteristics such as waveforms or frequencies of sampling data.

The sound-processed data 516, 518, 526, 528 are the data which are derived by performing the sound-processing to the frequency data 514, 524. The sound-processing shown in FIG. 5 is explained by assuming the panning processing which modifies or adjusts right and left volumes of the sound data independently. According to the present embodiment, the panning processing is attained by multiplying the right gain V1R and the left gain V1L of the sound data 510 to each data components of the sound data 514 to generate the right and left sound-processed data 516, 518 of the sound data 510. Similarly, the panning processing may be attained by multiplying the right gain V2R and the left gain V2L of the sound data 520 to each data components of the sound data 514 to generate the right and left sound-processed data 526, 528 of the sound data 520.

The synthesized data 530 is the data obtained by applying the synthesizing processing to the left hand processed data 516, 526 and by adding each components of the left hand processed data 516, 526. The synthesized data 532 is the data obtained by applying the synthesizing processing to the right hand processed data 518, 528 and by adding each components of the right hand processed data 518, 528. Finally, by applying the transformation processing to the synthesized data 530, 532 independently to generate the right and left sound signal of the sound data 510 520 as the transformation data 534 (S1R, S2R, . . . S128R) and the transformation data 536 (S1L, S2L, . . . , S128L).

Hereinabove, the present embodiments have been explained; however, the present invention must not be limited to the above embodiments. There may be other embodiments, additions, changes, deletions which are made by a person skilled at the art may be allowed to the present invention and any embodiments which provide work and technical advantage of the present invention may be included in the scope of the present invention.

BRIEF DESCRIPTION OF NUMERALS

100—functional construction, 110—sound-processing apparatus, 112—controller, 114—decoder, 116—inverse quantizer, 118—sound processor, 120—synthesizer, 122—transformer, 124—storage apparatus, 126—sound data buffer

The invention claimed is:

1. A sound-processing apparatus for processing encoded sound data comprising:

a storage apparatus storing the encoded sound data, the encoded sound data generated by encoding of sound data, a decoder for retrieving the encoded sound data from the storage apparatus and decoding the retrieved encoded sound data;

an inverse quantizer for generating frequency data by applying inverse quantization to decoded sound data;

a sound processor for applying sound-processing to the frequency data;

a synthesizer for synthesizing a plurality of frequency data; and a transformer for generating a sound signal by applying transformation processing to synthesized single frequency data.

2. The sound processing apparatus of claim 1, wherein the transformation processing executed by the transformer is IMDCT processing, IDCT processing, sub-band filtering processing or IIR filtering processing.

3. The sound processing apparatus of claim 1, wherein the encoded sound data is generated by applying MDCT processing, DCT processing, sub-band filtering processing or IIR filtering processing to the sound signal.

4. The sound-processing apparatus of claim 1, wherein the sound processor adjusts a volume of the sound data by multiplying gains corresponding to sound data to be play-backed to each component of the frequency data.

5. The sound-processing apparatus of claim 1, wherein the sound processor performs panning of the sound data by multiplying right and left gains corresponding to sound data to be play-backed to each component of the frequency data.

6. A non-transitory computer readable medium storing a computer executable method program for processing encoded sound data, the program causing the computer to execute:

decoding the encoded sound data retrieved from a storage apparatus;

generating plural frequency data by applying inverse quantization to the decoded sound data;

applying sound-processing to the plural frequency data;

synthesizing the plural frequency data; and generating a sound signal by applying transformation processing to the synthesized frequency data.

7. The computer readable medium of claim 6, wherein the transformation processing executed by the transformer is IMDCT processing, IDCT processing, sub-band filtering processing or IIR filtering processing.

8. The computer readable medium of claim 6, wherein the encoded sound data is generated by applying MDCT processing, DCT processing, sub-band filtering processing or IIR filtering processing to the sound signal.

9. The computer readable medium of claim 6, wherein the sound processing adjusts a volume of the sound data by multiplying gains corresponding to sound data to be play-backed to each component of the frequency data.

10. The computer readable medium of claim 6, wherein the sound processing performs panning of the sound data by multiplying right and left gains corresponding to sound data to be play-backed to each component of the frequency data.

11. A non-transitory computer readable medium making a sound-processing apparatus execute the program of claim 6.

12. A program product storing the computer executable program of claim 11.

* * * * *